United States Patent [19]

Lawrence

[11] 4,111,169

[45] Sep. 5, 1978

[54] SPARK IGNITION INTERNAL COMBUSTION ENGINES

[75] Inventor: Geoffrey Lloyd Lawrence, Stanmore, England

[73] Assignee: The Zenith Carburetter Company Limited, Stanmore, England

[21] Appl. No.: 645,394

[22] Filed: Dec. 30, 1975

[30] Foreign Application Priority Data

Dec. 31, 1974 [GB] United Kingdom ..... 56185/74

[51] Int. Cl.[2] ..... F02H 7/00

[52] U.S. Cl. ..... 123/119 EC; 123/124 B; 60/276; 261/121 B; 261/DIG. 63; 261/DIG. 74; 261/DIG. 19

[58] Field of Search ..... 123/119 E, 119 EC, 124 B, 123/119 R, 32 EA, 32 EE; 60/276, 285; 261/121 B, DIG. 63, DIG. 74, DIG. 19

[56] References Cited

U.S. PATENT DOCUMENTS

| | | | |
|---|---|---|---|
| 3,738,341 | 6/1973 | Loos | 123/119 E |
| 3,745,768 | 7/1973 | Zechnall et al. | 123/119 E |
| 3,900,014 | 8/1975 | Bundesen et al. | 123/119 EC |
| 3,963,009 | 6/1976 | Mennesson | 123/119 EC |
| 3,974,813 | 8/1976 | Knapp et al. | 123/119 EC |

FOREIGN PATENT DOCUMENTS

| | | | |
|---|---|---|---|
| 2,444,695 | 4/1975 | Fed. Rep. of Germany | 123/119 EC |

*Primary Examiner*—Charles J. Myhre
*Assistant Examiner*—Ira S. Lazarus
*Attorney, Agent, or Firm*—Stevens, Davis, Miller & Mosher

[57] ABSTRACT

An oxygen sensor is fitted to the exhaust pipe of a spark ignition internal combustion engine so that it projects into the exhaust gas stream. Its output is connected to a comparator circuit which has its output connected to the actuator of a variable airflow controller which controls airflow through an air supply passage which is connected to the fuel supply jet of an air valve carburetor between the fuel metering orifice and the fuel discharge nozzle of that carburetor. The comparator circuit emits an output when the oxygen sensor detects that the ratio of the air/fuel mixture fed to the engine by the carburetor is either richer or leaner than the stoichiometric ratio. The output from the comparator circuit drives the variable air flow controller in the appropriate direction to tend to return the ratio of the air/fuel mixture fed by the carburetor to the engine towards stoichiometry. An auxiliary air supply passage may be connected to the induction passage downstream of the throttle valve. A variable restrictor in the auxiliary air supply passage is controlled by the output from the oxygen sensor so that the supply of air through the auxiliary air supply passage to the induction passage is varied in same way to change the air/fuel ratio and return it towards stoichiometry.

12 Claims, 9 Drawing Figures

10
13
32
33
18
22
100
101
98
91
99
92
97
96
94
95
93
90

SPARK IGNITION INTERNAL COMBUSTION ENGINES

This invention relates to spark ignition internal combustion engines which include a carburetter and an exhaust system. Carburetors for such an engine have a body in which an induction passage is formed, the induction passage providing a flow path for air which is drawn into the engine by operation of the engine, there being a throat of restricted dimensions within the induction passage and a driver operable throttle valve downstream of that throat for controlling the mass flow of air through the induction passage. Such carburetors also have a fuel supply system comprising a fuel metering orifice, a fuel discharge nozzle and a source of liquid fuel, the fuel supply system being arranged so that metered quantities of liquid fuel are drawn from said source through the fuel metering orifice and the fuel discharge nozzle into the induction passage by air flow through said throat so that fuel drawn through the discharge nozzle is atomized and dispersed within that part of the induction passage between the throat and the throttle valve so as to mix with air that flows through said throat and form an air fuel mixture which flows to the engine. A spark ignition internal combustion engine which includes such a carburetor and an exhaust system is referred to below as a spark ignition internal combustion engine of the kind referred to.

Ideally the carburetor is arranged so that the proportions of air and fuel in the air/fuel mixture which is drawn from the induction passage of the carburetor by operation of the engine are such that the amount of fuel that is conveyed to the engine is optimised so that sufficient fuel is supplied to meet the requirements of the engine and so that a significant proportion of that fuel is burnt totally within the combustion chambers of the engine with the result that the engine exhaust includes a minimum of uncombusted or partially combusted fuel. The ratio of air to fuel in such an optimum air/fuel mixture is known as the stoichiometric ratio. It is difficult to provide such a carburetor with metering means which perform at the optimum level at all times. It is especially difficult to ensure optimum metering performance of the carburetor metering means during transient modes of operation of the carburetor, such as during acceleration or deceleration of the vehicle in which the engine is incorporated.

It is an object of this invention to reduce the tendency for the metering performance of a carburetor for an internal combustion engine of the kind referred to, to be imperfect under some of the range of conditions of operation of the carburetor, and especially during the transient modes of operation.

According to this invention there is provided a spark ignition internal combustion engine of the kind referred to, wherein the exhaust system includes exhaust gas constituent sensing means which are operable to monitor the ratio between the quantity of one of the constituents of the gas flow that is exhausted from the engine by operation of the engine and the remainder of that exhaust gas flow and to emit a signal when that ratio differs from a predetermined optimum ratio by a predetermined amount, that signal being indicative of the sense of the difference between the ratio that is sensed at any one instant and the predetermined optimum ratio, control means which are operable to vary one of the two factors, namely the effective cross-sectional area of the fuel metering orifice and the pressure drop across the fuel metering orifice, that together determine the metered quantity of fuel that is drawn through the fuel metering orifice by a given air flow through the throat, signal transmitting means for transmitting to the control means the said signal that is emitted by the exhaust gas constituent sensing means, the control means being operable in response to a signal received from the exhaust gas constituent sensing means to vary said one factor so that the quantity of fuel drawn from said source through the fuel metering orifice and the fuel discharge nozzle into the induction passage by a given air flow through the throat is changed, the variation in said one factor being the form of variation that will lead to a reduction in the difference between the said ratio and the predetermined optimum ratio.

There may be a supplementary air supply passage which is connected to the induction passage downstream of the throttle valve, there being a variable flow restricting devide in said supplementary air supply passage and control means for controlling the variable flow restricting device, the variable flow restricting device control means being connected to the signal transmitting means and being operable in response to a signal received via the signal transmitting means from the exhaust gas constituent sensing means to vary the restriction to air flow through said supplementary air supply passage afforded by said variable flow restricting device, the variation in the restriction to air flow through said supplementary air supply passage being the form of variation that will lead to a reduction in the difference between the said ratio and the predetermined optimum ratio when the engine is at or near idling.

Preferably the carburetor is of the air valve type that has an air valve upstream of the driver operable throttle valve and just one such fuel supply system for supplying metered quantities of fuel to that part of the induction passage between the throttle valve and the air valve, the air valve co-operating with the wall of the induction passage to form said throat and being controlled by the depression that is established in that part of the induction passage between the throttle valve and the air valve in order to vary the area of the throat and maintain that depression substantially constant.

The preferred form of control means comprise an air flow passage which is connected to the fuel supply system upstream of the fuel discharge nozzle, variable air flow metering means for metering air flow through the air flow passage and varying means which are connected to the signal transmitting means and which are operable in response to a signal received via the signal transmitting means from the exhaust gas constituent sensing means to vary the performance of the air flow metering means so that the pressure drop across the fuel metering orifice is changed by the consequent change in air flow through said air flow passage. The air flow passage may be connected to the fuel supply system between the source of liquid fuel and the fuel discharge nozzle, preferably between the fuel metering orifice and the fuel discharge nozzle, so that metered quantities of air are drawn into the fuel supply system upstream of the fuel discharge nozzle and are mixed therein with fuel that is drawn through the fuel metering orifice so that a mixture of metered quantities of fuel and air is drawn through the fuel discharge nozzle into the induction passage by air flow through the throat, the quantities of air drawn from the air flow passage into the fuel supply system upstream of the fuel discharge nozzle being metered by the variable air flow metering means.

Where the engine includes a supplementary air supply passage as described above, the variable air flow metering means and the variable flow restricting device may be coupled together for complementary operation under the control of a common control device which functions as both said varying means and said variable flow restricting device control means.

The variable air flow metering means may comprise a needle valve or a rotary valve. A suitable rotary valve comprises a housing; a cavity which is formed in the housing; an air inlet port and an air outlet port which are formed in the housing, which communicate with the cavity within the housing and which are connected into the air flow passage, the air outlet port being connected to the fuel supply system by the downstream portion of the air flow passage; and a rotary element which is coupled to said varying means for rotation within the cavity and which co-operates with the outlet port so that, for at least some of the angular positions of the rotary element within the cavity, part of the outlet port is obscured from the interior of the cavity by the rotary element, the proportion of the outlet port that is obscured from the interior of the cavity by the rotary element being varied by rotation of the rotary element within the cavity. The rotary element may comprise a disc which has an arcuate slot formed in it, the width of the arcuate slot, as measured radially with respect to the axis of rotation of the disc, being smaller at one end of the arcuate slot than at the other end of the arcuate slot and increasing progressively from said one end along the slot towards said other end.

The varying means may include an electric motor which has a rotary output spindle which is coupled drivingly with the variable air flow metering means. Where the air flow metering means comprise a needle valve, the rotary output spindle of the electric motor may be coupled drivingly with the needle valve by a rack and pinion mechanism. Alternatively the varying means may include a solenoid device which has an armature and a solenoid winding, the armature being connected to the needle valve.

Where the variable air flow metering means and the variable flow restricting means are coupled together for complementary operation they may comprise a tandem needle valve which may be a sliding fit within a bore so that it controls communication between each of a pair of inlet ports within the bore and each of a pair of outlet ports within the bore, one of the outlet ports being connected to the fuel supply system by said air flow passage and the other outlet port being connected to the induction passage downstream of the throttle valve by said supplementary air supply passage. The tandem needle valve may include a cylindrical land by which said one outlet port can be blocked and another cylindrical land between the two needle portions.

Preferably the exhaust gas constituent sensing means comprise an oxygen sensor which produces a signal which is a complex function of the ratio between the quantity of oxygen in the gas flow that is exhausted from the engine by operation of the engine and the other constituents of that exhaust glas flow, that signal being the signal that is emitted by the exhaust gas constituent sensing means and transmitted by the signal transmitting means to the control means.

Examples of this invention will be described now with reference to the accompanying drawings, of which:

Figure 1:
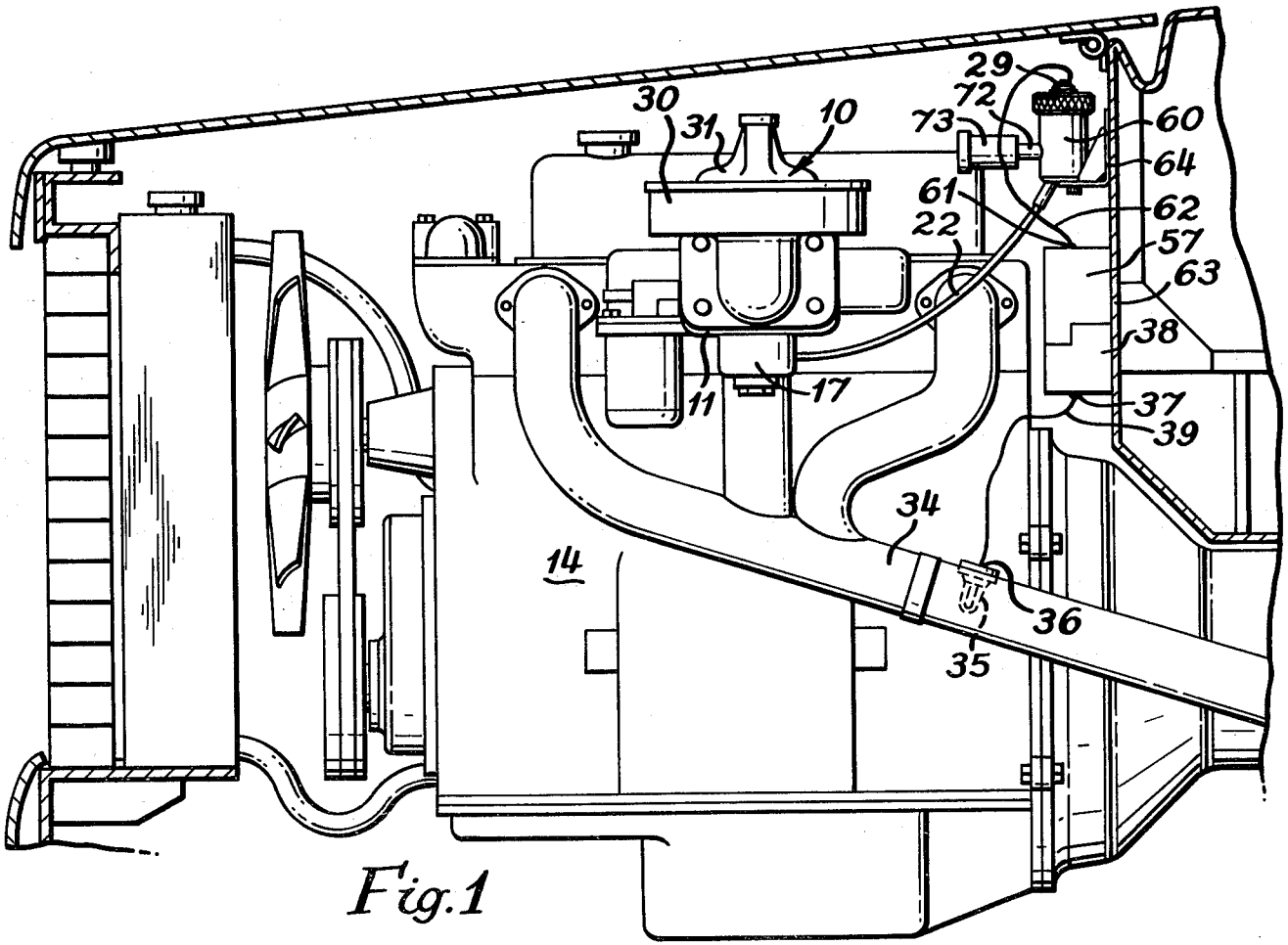
FIG. 1 is a side elevation of one form of spark ignition internal combustion engine installation in which this invention is embodied.
Figure 2:
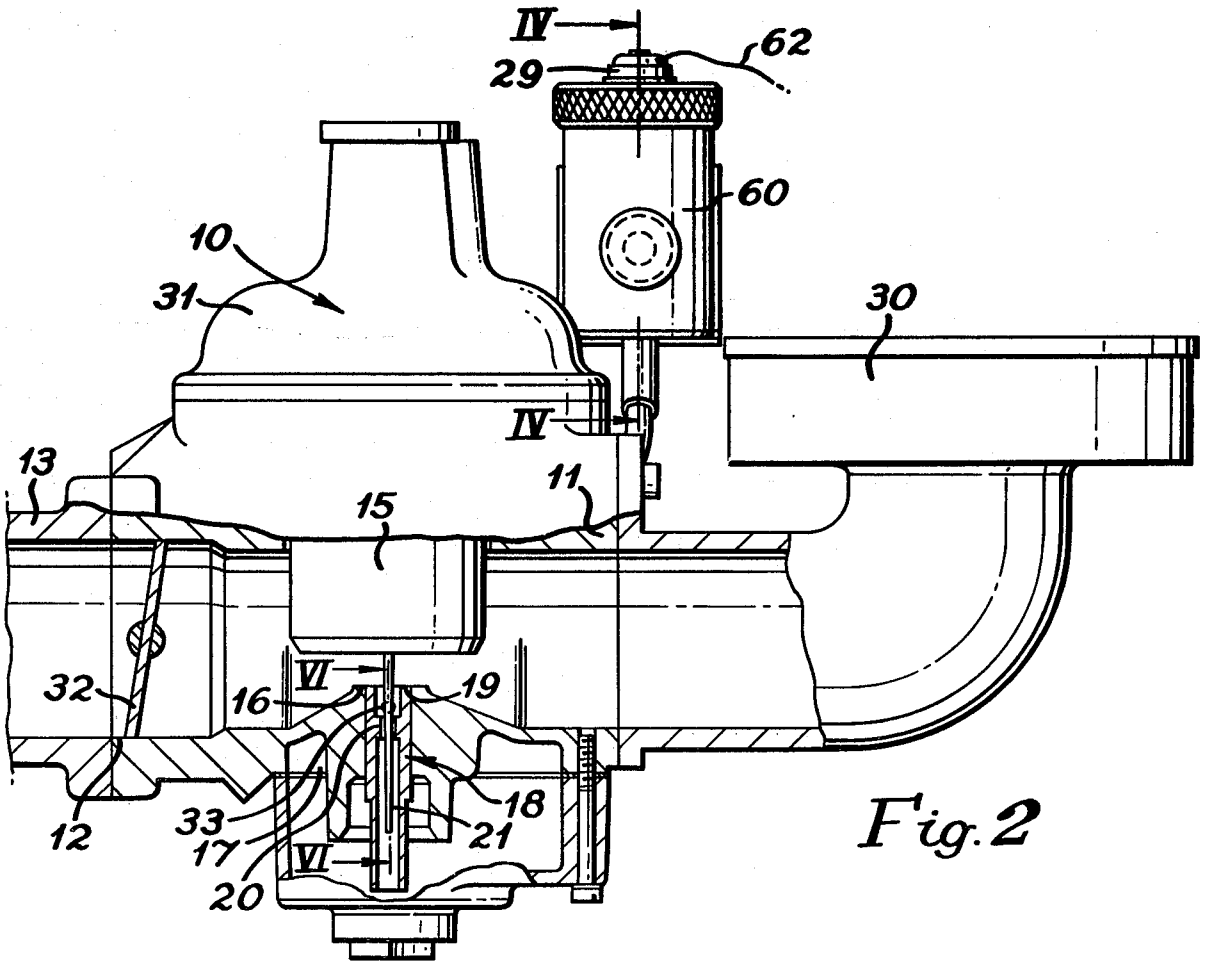
FIG. 2 is an elevation of a subassembly of the engine installation shown in FIG. 1, the sub-assembly including the carburetor and being partly sectioned in the region of the induction passage and the fuel chamber.

Referring to FIG. 2 of the drawings, an air valve carburetor 10 has a body 11 in which a through passage 12 is formed. The through passage 12 constitutes the induction passage of the carburetor 10 and has its downstream end connected to the inlet manifold 13 of a spark ignition internal combustion engine 14 of a motor vehicle (see FIG. 1). An air filter 30 is fitted to the upstream end of the through passage.

The air valve member of the carburetor 10 is a slide valve piston 15 which co-operates in the well known manner with a bridge 16 to form a throat of variable area within the induction passage 12, the bridge 16 being formed by the portion of the wall of the through passage 12 which is opposite the aperture in the wall of the through passage 12 through which the slide valve piston 15 slides. Operation of the slide valve piston 15 is controlled in the usual manner by differential air pressure acting on a diaphragm (not shown) which divides into two chambers a space (not shown) enclosed in part by the carburetor body 11 and in part by a cap member 31 which is secured to the body 11.

The carburetor 10 also comprises a float chamber 17 in which a substantially constant volume of fuel is stored and a fuel supply jet 18 which is in communication with the float chamber 17. The fuel supply jet 18 opens into the throat of the carburetter 10 through a fuel discharge nozzle 19 which is formed at the end of the jet 18 remote from the float chamber 17. The fuel supply jet 18 has an orifice 20 of restricted dimensions formed in it between the fuel discharge nozzle 19 and the float chamber 17. The orifice 20 of restricted dimensions functions as a fuel metering orifice and its effective area is varied, with the position of the air valve slide piston 15, by a profiled needle 21 which is attached to the piston 15. Fuel is drawn from the float chamber 17 through the fuel supply jet 18 in the well known manner by air flow through the throat.

The carburetor 10 also includes a throttle valve 32 in the induction passage 12 downstream of the air valve slide piston 15. The throttle valve 32 is connected to the usual driver's throttle pedal (not shown) by a conventional throttle linkage (not shown).

FIG. 1 shows that the spark ignition internal combustion engine 14 has an exhaust pipe 34. A lambda sensor 35 includes a probe portion and is fitted to the exhaust pipe 34 so that the probe portion projects into the interior of the exhaust pipe 34. Basically the probe portion of the lambda sensor 35 comprises an oxygen concentration cell with a solid electrode that is composed of zirconium dioxide coated with platinum on both sides. One side of the electrode is exposed to ambient air and the other side is exposed to the exhaust gas flow through the exhaust pipe 34. The electrode produces an electrical potential which is related in a complex way to the partial pressure of oxygen in the exhaust gas flow as compared with that of the ambient air. That electrical potential can be taken to be an indication of the ratio of air to fuel in the charge that is fed from the carburetor 10 to the engine 14 through the induction manifold 13, and has a significantly changing output function in the stoichiometric region. Thus the potential developed by the electrode of the lambda sensor 35 is an analogue output signal which is a complex function of the proportion of oxygen in the exhaust gas flow at any one instant and which is a useful indication of the ratio of air to fuel of the charge that was fed to the engine 14 to produce that exhaust gas flow. The lambda sensor 35 has an output terminal 36 which is connected to an input 37 of a comparator circuit 38 by a lead 39.

Figure 3:
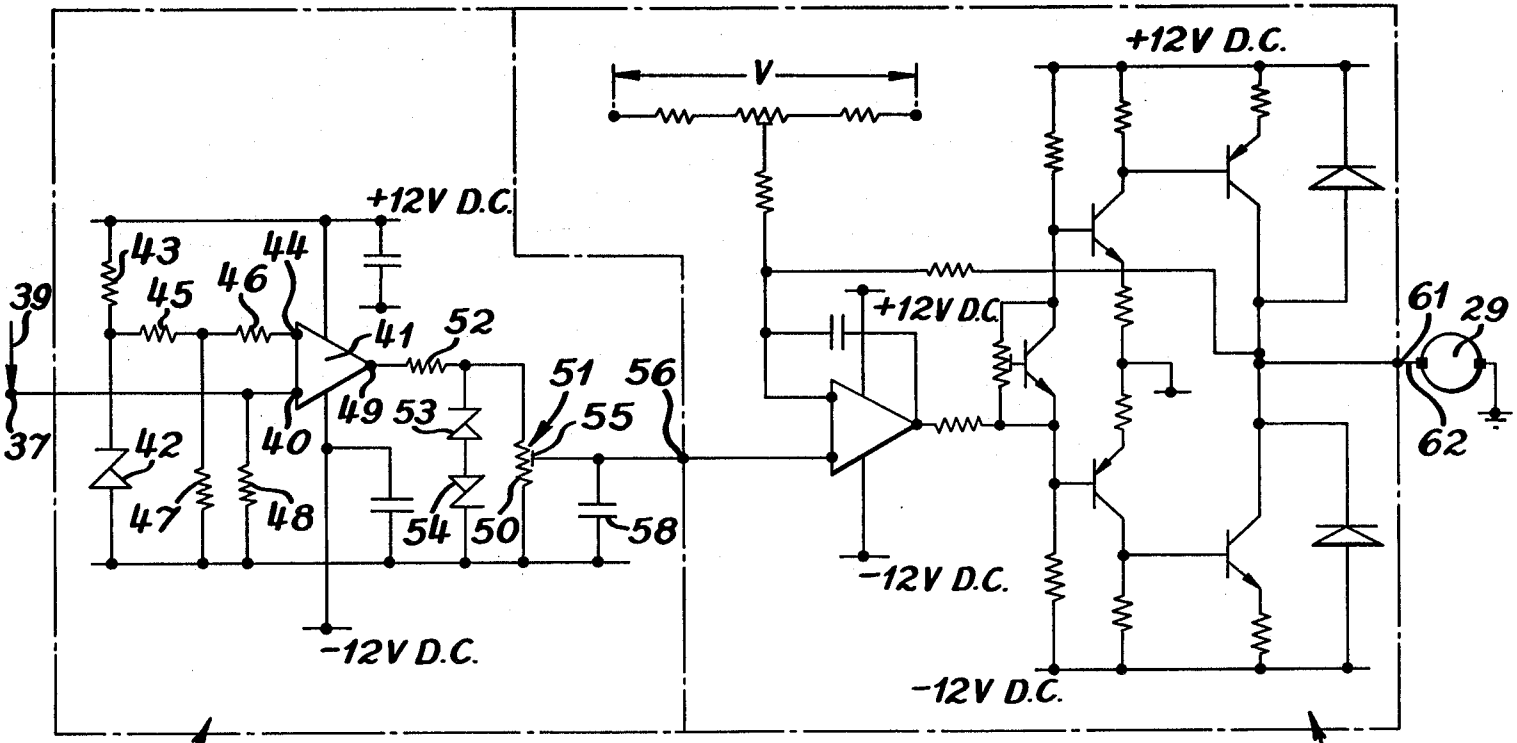
FIG. 3 is a circuit diagram of electrical control equipment incorporated in the engine installation shown in FIG. 1.

Details of the comparator circuit 38 are shown in FIG. 3. The input 37 is connected to one input 40 of an operational amplifier 41. A zener diode 42 and a fixed resistor 43 are connected in series between a terminal which is at a positive D.C. potential of 12 volts and earth. The junction between the zener diode 42 and the resistor 43 is connected to the other input 44 of the operational amplifier 41 by a pair of fixed resistors 45 and 46 which are in series .The junction of the fixed resistors 45 and 46 is connected to earth through a fixed resistor 47. A constant voltage is produced at the junction of the zener diode 42 and the fixed resistor 43. The magnitude of that constant voltage is reduced by the fixed resistor 45 and 47 and the reduced voltage is used as a reference voltage. The fixed resistor 46 and another fixed resistor 48, which is connected between the input and earth, serve to match the impedances of the signals that are received by the two inputs 40 and 44 of the operational amplifier 41. The zener diode 42 and the fixed resistors 43, 45 and 47 are selected in relation to the voltage of the positive D.C. potential so that the reference voltage is equal to the voltage of the analogue output signal that is produced by the lambda sensor 35 when stoichiometry occurs.

The operational amplifier 41 produces an output signal of a given voltage at its output 49 when the voltage of the analogue output signal that it receives at its input 40 differs from the reference voltage at its other input 44. The output signal at the output 49 is either positive or negative depending upon whether the voltage of the analogue output signal is greater than or less than the reference voltage.

The output 49 of the operational amplifier 41 is connected to the wire 50 of a preset potentiometer 51 through a fixed resistor 52. The junction between the fixed resistor 52 and the wire 50 is connected to earth through a reversed biassed pair of zener diodes 53 and 54. The tapping 55 of the potentiometer 51 is connected to the output 56 of the comparator circuit 38, which in turn is connected to the input of a motor driver circuit 57, and is connected to earth through a capacitor 58.

An electric motor 29, which forms part of a rotary air flow controller 60, has on of its terminals connected to the output 61 of the motor driver circuit 57 by a lead 62 and its other terminal connected to earth. The motor driver circuit 57 functions as a power amplifier to amplify the current of a signal which it receives from the output 56 of the comparator circuit 38 so that the current that is supplied to the electric motor 29 is sufficient to drive the motor 29. The potentiometer 51 is set when the comparator circuit 38 is assembled so that it cooperates with the capacitor 58 to reduce the voltage of the signal that is emitted by the operational amplifier 41 to the level that is necessary for the motor 29 to be driven at the desired speed. The pair of reversed biassed zener diodes 53 and 54 serve to ensure that the output signal that is transmitted to the motor driver circuit 57 when the voltage of the analogue output signal that is received by the comparator circuit 38 is less than the reference voltage, and the output signal that is transmitted to the motor driver circuit 57 when the voltage of the analogue output signal that is received by the comparator circuit 38 is greater than the reference voltage are balanced so that excessive hunting of the electric motor 29 in one direction of rotation as compared with the other direction is avoided.

Thus the motor 29 is energised by an output signal from the motor driver circuit 57 for rotation in one sense, if the voltage of the analogue output signal exceeds the reference voltage, or in the opposite sense if the reference voltage exceeds the voltage of the analogue output signal. It will be appreciated that the proportion of air in the fuel/air mixture drawn from the carburetter 10 is excessively high if the lambda sensor 35 detects that the proportion of oxygen in the exhaust exceeds the optimum level, whereas it is too low if the lambda sensor 35 detects that the proportion of oxygen in the exhaust is less than the optimum level.

The comparator circuit 38, the motor driver circuit 57 and the rotary air flow controller 60 are mounted on the bulkhead 63 that separates the engine compartment of the vehicle from the driver's compartment. The rotary air flow controller 60 is mounted upon the bulkhead 63 by an angle support bracket 64.

Figure 4:
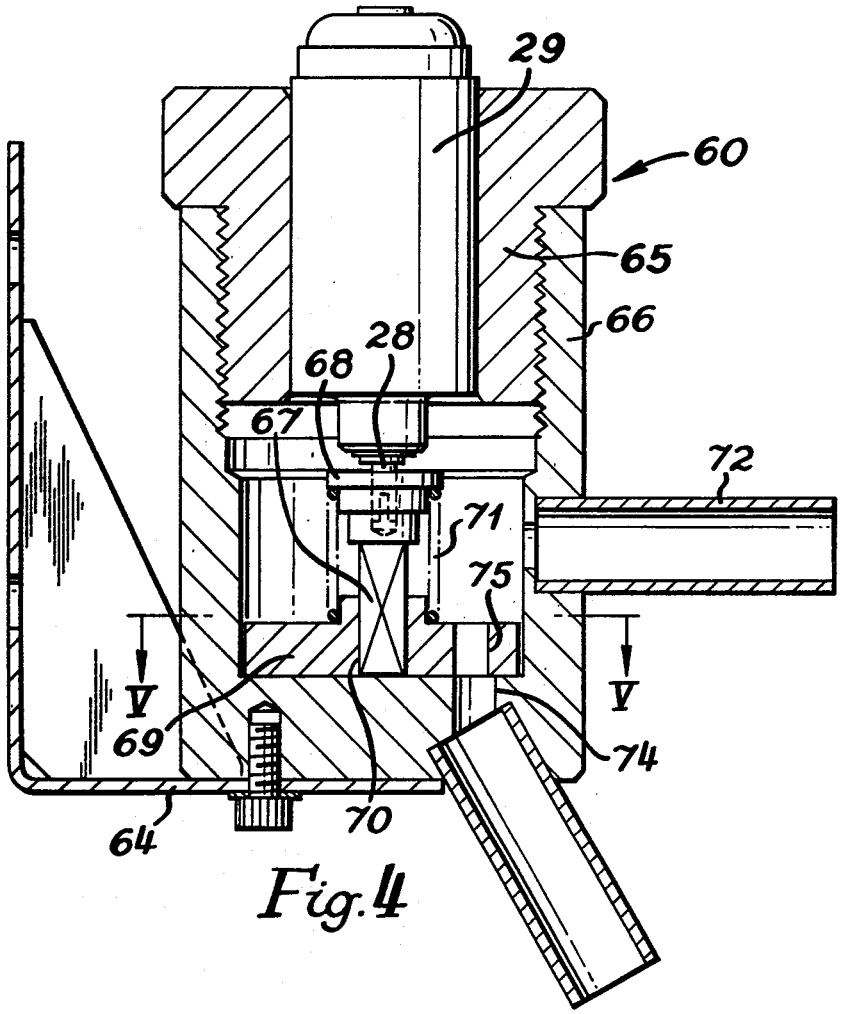
FIG. 4 is a section on the line IV—IV in FIG. 2 of a detail of the engine installation shown in FIG. 1 which is a variable air flow controller.
Figure 5:
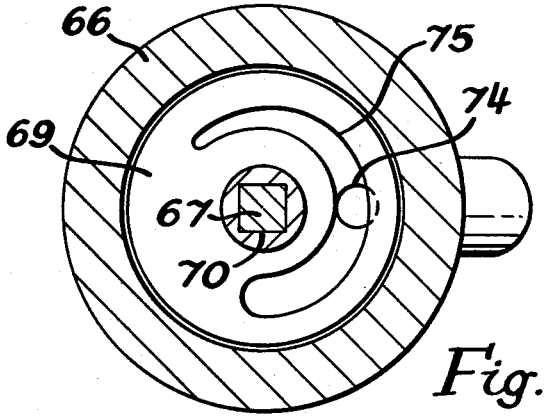
FIG. 5 is a section on the line V—V of FIG. 4.

The motor 29 has an integral gearbox and is supported by a tubular bush 65 into which it is spigotted as shown in FIG. 4. The bust 65 is screwed into the mouth of a cup-shaped body 66. The motor/gearbox assembly has an output drive spindle 28 which is spigotted into a blind axially-extending bore that is formed at one end of a square shaft 67. A radial flange 68 is formed at said one end of the square shaft 67. A disc 69 of resilient plastics material has a square hole 70 at its centre, the square shaft 67 being a sliding fit within the square hole 70. A coil spring 71 reacts against the radial flange 68 and urges the disc 69 against the base of the cup-shaped body 66. The interior of the cavity of the cup-shaped body 66 between the disc 69 and the tubular bush 65 is placed in communication with the interior of the engine compartment of the vehicle through an inlet pipe 72 and an air filter 73. An outlet port 74 is formed in the base of the cup-shaped body 66. An arcuate slot 75 is formed in the disc 69. FIG. 5 shows that the width of the arcuate slot 75, as measured radially with respect to the square shaft 67, is smaller at one end of the slot 75 than at the other and increases progressively along the slot 75 from the smaller end to the larger end. Communication between the outlet port 74 and the interior of the cavity of the cup-shaped body 66 between the disc 69 and the tubular bush 65 is dependent upon the angular orientation of the disc 69 with respect to the body 66 and is via that part of the angular slot 75 that is aligned with it. Hence the effective cross-sectional area of the outlet port 74 is varied by rotation of the disc 69.

Figure 6:
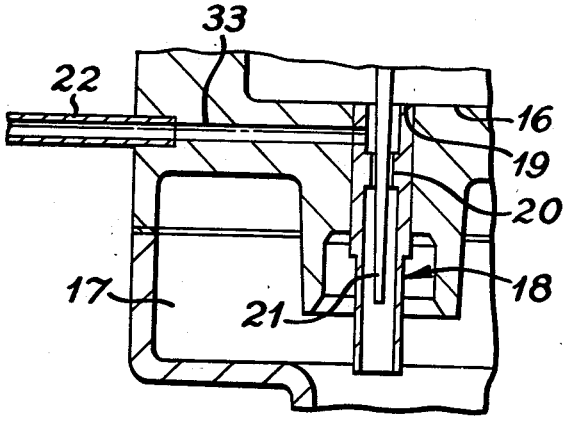
FIG. 6 is a section through the carburetter on the line VI—VI in FIG. 2.

The outlet port 74 of the rotary air flow controller 60 is connected to one end of an air supply passage 22 (see FIG. 1) which has its other end spigotted into a bore 33 in the body of the carburetor 10 (see FIG. 6) the bore 33 being in communication with the bore of the fuel supply jet 18 between the fuel metering orifice 20 and the fuel discharge nozzle 19. The air supply passage 22 is as short as is practical having regard to the particular engine installation, in oder to minimize the time for transmission of an air signal through it.

The lambda sensor 35 monitors the exhaust gas flow through the exhaust pipe 34 continuously whenever the engine 14 is in operation. Hence it transmits an analogue control signal to the comparator circuit continuously. There is no output signal from the operational amplifier 41 if the air/fuel ratio of the charge that is supplied to the engine 14 is stoichiometric. Hence the motor 29 is not driven and the air flow through the air supply passage 22 is unaltered. An air/fuel mixture that has a proportion of fuel to air that is greater than the stoichiometric ratio is referred to hereinafter as being rich whilst an air/fuel mixture that has a proportion of fuel to air that is less than the stoichiometric ratio is referred to hereinafter as being lean.

When the air/fuel ratio of the charge is richer than the stoichiometric ratio, the voltage of the analogue control signal emitted by the lambda sensor 35 is greater than the reference voltage, the quantity of oxygen in the exhaust gas flow being less than the optimum. Hence there is an output signal of one sense from the operational amplifier 41 so that the electric motor 29 is driven to rotate the disc 69 in the sense that moves the larger end of the arcuate slot 75 towards the outlet port 74. The effective area of the outlet port 74 is enlarged as a result and this leads to an increase in the amount of air that can be drawn through the air supply passage 22 into the fuel supply jet 18 by the action of air flow through the variable area throat that is formed between the slide valve piston 15 and the bridge 16. Such an increase in air flow into the fuel supply jet 18 from the air supply passage 22 reduces the pressure drop across the fuel metering orifice 20 with a consequent reduction in the amount of fuel that can be drawn through the fuel metering orifice 20 by the action of air flow through the variable area throat. The increase in the amount of air that can be drawn into the fuel supply jet 18 from the air supply passage 22 and the reduction in the amount of fuel that can be drawn through the fuel metering orifice 20 by air flow through the variable area throat leads to an increase in the proportion of air in the air/fuel mixture that is drawn from the carburetor 10 by the engine. The amount of air that can be drawn through the air supply passage continues to be increased by operation of the motor driven rotary disc valve which comprises the rotary air flow controller 60 with the consequent reduction in the amount of fuel that can be drawn through the fuel metering orifice 20 until the analogue control signal output from the lambda sensor 35 indicates that stoichiometry has been established whereupon the output from the operational amplifier 41 of the comparator circuit 38 ceases and the electric motor 29 stops.

The electric motor 29 is driven in the opposite sense to move the smaller end of the arcuate slot 75 towards the outlet port 74 and thus reduce the amount of air that can be drawn through the air supply passage 22 by air flow through the variable area throat, when the lambda sensor 35 indicates that the air/fuel ratio of the charge drawn from the carburetor 10 by the engine 14 is too lean, the amount of oxygen in the exhaust gas flow being too great. This is because the voltage of the analogue control signal emitted by the lamdba sensor 35 is less than the reference voltage and an output of the opposite sense to that described in the previous paragraph is emitted by the operational amplifier to drive the motor 29. The pressure drop across the fuel metering orifice 20 is increased by the increased resistance to air flow through the air flow supply passage 22 into the fuel supply jet 18 so that the amount of fuel that can be drawn through the fuel metering orifice 20 by air flow through the variable area throat is increased so that the air/fuel mixture drawn from the carburetor 10 by operation of the engine 14 is made richer.

The disc 69 and the outlet port 74 of the rotary air flow controller 60 co-operate together to function as a variable air metering device which meters air flow through the air supply passage 22 under the control of the control apparatus which comprises the lambda sensor 35, the comparator circuit 38, the motor driven circuit 57 and the electric motor 29. Other forms of air flow controllers which are driven by the electric motor 29 in a manner similar to that just described, and other forms of electro-mechanical transducer systems for operating such a variable air metering device in response to the analogue control signals emitted by the lambda sensor 35 may be used to carry out this invention.

Figure 7:
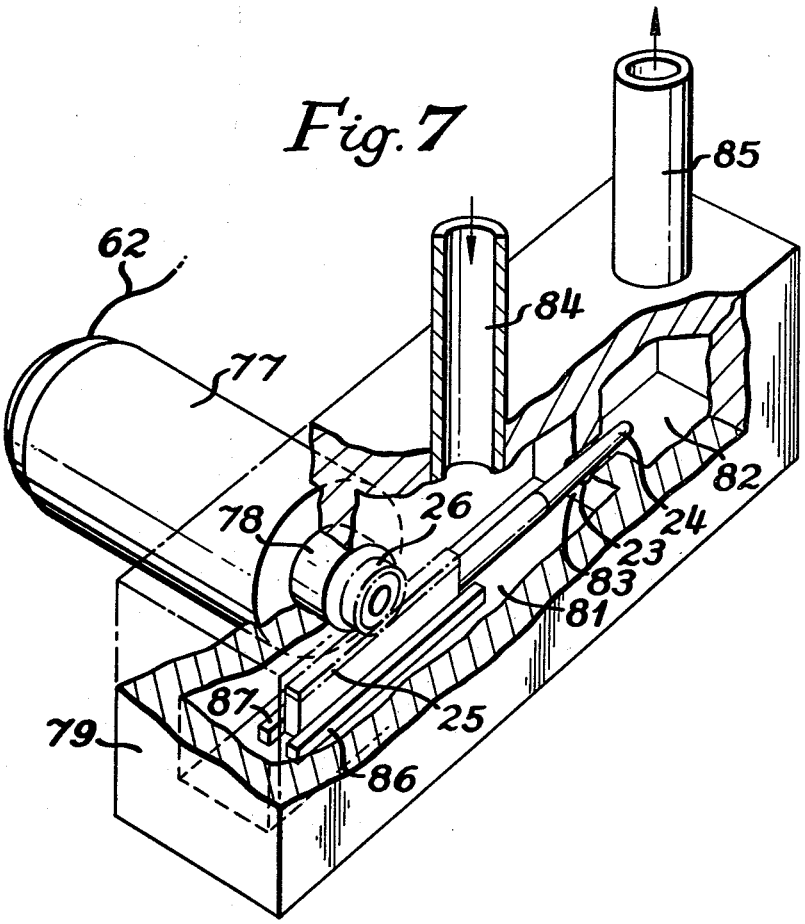
FIG. 7 is a view in perspective of a modified form of variable air flow controller for use in the engine installation shown in FIG. 1.

FIG. 7 shows an air flow controller 76 for use in place of the rotary air flow controller 60 of the arrangement described above with reference to FIGS. 1 to 6. A combined electric motor and gearbox assembly 77 has one terminal (not shown) connected to earth and another terminal to which the lead 62 is connected. The output shaft 78 of the motor/gearbox assembly 77 passes through an aperture in a wall of a housing 79 and carries a pinion wheel 26 within the housing 79. The interior of the housing 79 is divided into two chambers 81 and 82 by a partition 83. The chamber 81 communicates with the interior of the engine compartment of the vehicle via an inlet port 84 and the air filter 73. The chamber 82 has an outlet port 85 which is connected to the air supply passage 22. An air metering orifice 23 is formed in the partition 83. The effective area of the air metering orifice 23 is controlled by a profiled needle 24. The needle 24 is carried by a rack 25 which meshes with the pinion wheel 26. The rack 25 is guided by a pair of parallel guide bars 86 and 87 within the chamber 81 for linear movement which moves the needle 24 to and fro within the air metering orifice 23 to vary the area of that metering orifice 23.

When the voltage of the analogue control signal emitted by the lambda sensor 35 is less than the reference signal because the air/fuel ratio of the charge drawn into the engine 14 from the carburetor 10 by operation of the engine 14 is too lean and thus when the proportion of oxygen in the exhaust is too high, the combined motor/gearbox assembly 77 drives the pinion 26 to drive the rack 25 in the direction which results in the needle 24 being moved into the air metering orifice 23. Thus the effective area of the air metering orifice 23 is reduced with a consequent reduction in the quantity of air that can be drawn therethrough into the fuel supply jet 18 via the air supply passage 22 and a consequent increase in the pressure drop across the fuel metering orifice 20 so that the proportion of fuel in the air/fuel mixture that flows into the induction passage 12 through the fuel discharge nozzle is increased and thus so that the proportion of fuel in the air/fuel mixture drawn from the carburetor 10 by the engine 14 is increased. On the other hand, rotation of the motor of the combined motor/gearbox assembly 77 in the opposite sense, which occurs when the voltage of the analogue control signal is greater than the reference voltage which occurs when the air/fuel mixture drawn from the carburetor 10 by operation of the engine is too rich and the proportion of oxygen in the exhaust is too low, leads to the needle 24 being withdrawn from the air metering orifice 23 so that the effective area of that orifice 23 is increased, the proportion of air that can be drawn therethrough into the fuel supply jet 18 via the air supply passage 22 is increased also, and the pressure drop across the fuel metering orifice 20 is reduced so that the proportion of air in the air/fuel mixture drawn from the carburetor 10 by the engine 14 is increased and that mixture is made less rich.

Figure 8:
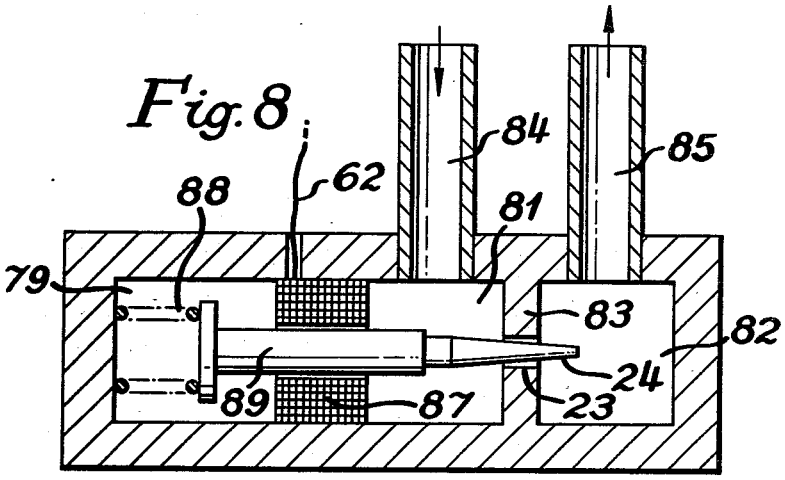
FIG. 8 is a transverse section through another form of variable air flow controller for use in the engine installation shown in FIG. 1.

FIG. 8 shows another form of air flow controller 86 for use in place of the rotary air flow controller 76 in the arrangement that has been described above with reference to FIG. 7. The controller 86 incorporates a solenoid device for operating the needle valve to control the effective area of the air metering orifice 23. Those parts of the air flow controller 86 that are similar to corresponding parts of the air flow controller 76 are identified by the same references.

The comparator circuit 38 is modified so that its operational amplifier emits one of three positive output voltage signals, a low output voltage signal, a medium output voltage signal and a high output voltage signal. The low signal is emitted when the voltage of the analogue control signal emitted by the lambda sensor 35 is greater than the reference voltage. The medium signal is emitted when the voltage of that analogue control signal is equal to the reference voltage. The high signal is emitted when the voltage of that analogue control signal is less than the reference voltage.

The lead 62 is connected to the winding 87 of the solenoid device. The needle 24 is urged to close the orifice 23 by a coil spring 88 which reacts against the housing 79.

The needle valve 24, which is carried by the armature 89 of the solenoid device, is held in a median position with the coil spring 88 partly compressed when the charge that is drawn into the engine 14 from the carburetor 10 is stoichiometric and the voltage of the analogue control system emitted by the lambda sensor 35 is equal to the reference voltage.

When the charge that is drawn into the engine 14 goes rich, the voltage of the analogue control signal is greater than the reference voltage so that the high output voltage signal is fed to the solenoid winding 87. Hence the electro-magnetic force applied to the armature 89 is at its greatest and the effective area of the orifice 23 is maximised, the needle 24 being fully retracted and the coil spring 88 compressed to the maximum extent. When the charge that is drawn into the engine 14 goes lean, the voltage of the analogue control signal is less than the reference voltage and the low output voltage signal is emitted. Hence the electro-magnetic force is reduced and the coil spring 88 is allowed to expand to urge the needle 24 into the orifice 23 to reduce the effective area of that orifice.

The time interval between the emission by the lambda sensor 35 of an analogue control signal which is indicative of the air/fuel ratio of the charge drawn into the engine at a given instant and the consequent change in the air/fuel ratio of the charge is longer at engine idling and near idling conditions, when the mass flow through the induction passage is low, than it is when the throttle is partly or fully opened and the mass flow through the induction passage is much greater. This time interval can be undesirably long. In order to cater for this problem, a supplementary air supply passage which is connected to the induction passage downstream of the throttle valve can be provided. A variable flow restricting device would be included in such a supplementary air supply passage and its performance would be controlled by the same control signal that controls operation of the variable air flow controller 60, 76, 86. An example of such an arrangement is illustrated in FIG. 9.

Figure 9:
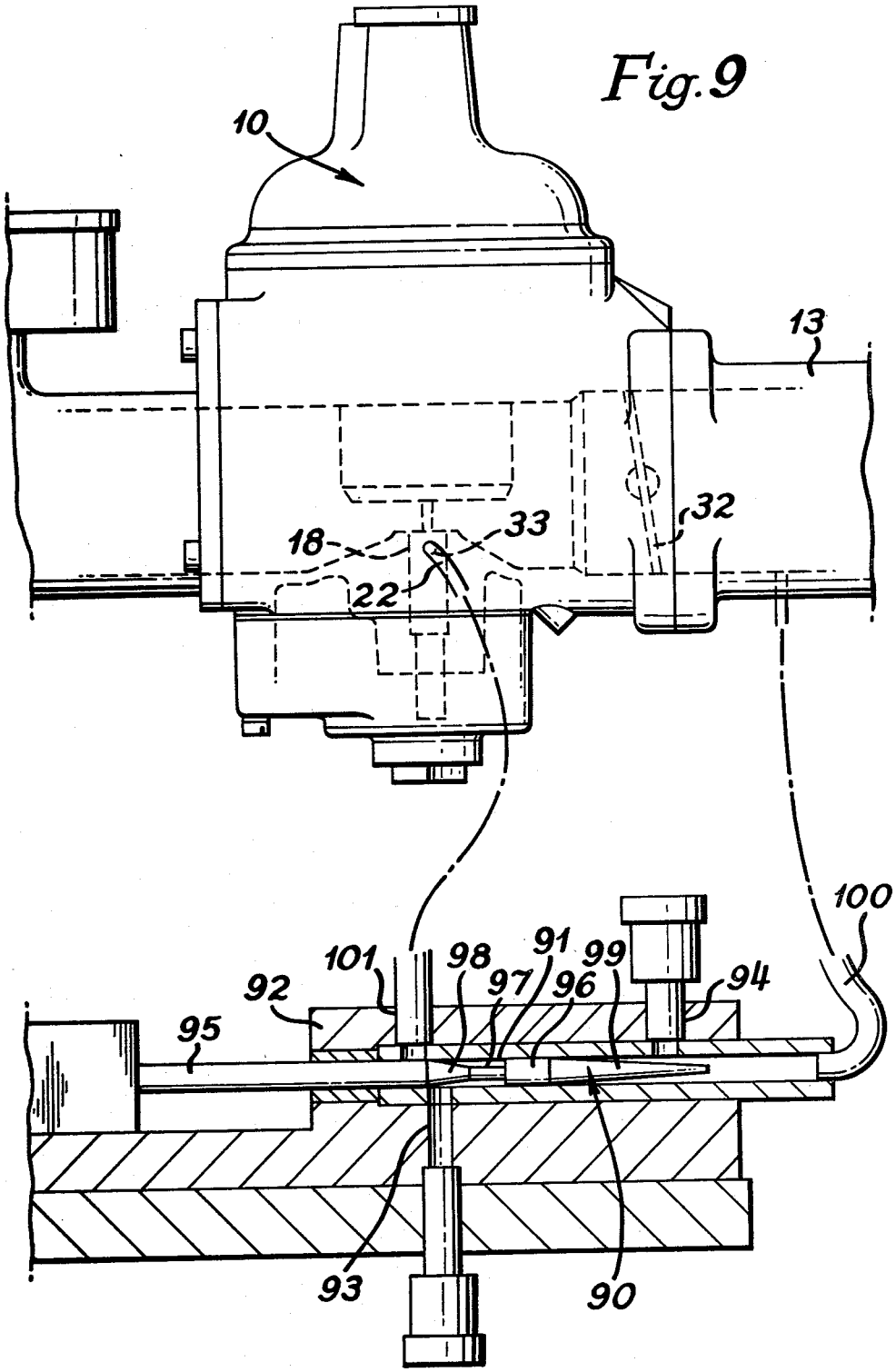
FIG. 9 illustrates a modification of the engine installation shown in FIG. 1.

Referring to FIG. 9, a tandem needle valve is a sliding fit in a bore 91 in a housing 92. There are two inlet ports 93 and 94 in the bore 91 which are spaced from one another with respect to the axis of the bore and which are each in communication with the interior of the engine compartment through an air cleaner. One end of the tandem needle valve 90 comprises a cylindrical land 95 which is a sliding fit in the bore 91 and which projects from one end of the bore 91. The projecting portion of the land 95 conveniently is coupled to the armature of a solenoid device or to a rack member by which the position of the tandem needle valve 90 within the bore 91 is controlled in a manner similar to that which has been described above with reference to FIGS. 7 and 8. The needle valve 90 also has an intermediate cylindrical land 96 which is a sliding fit within the bore 91 and which is connected to the land 95 by a reduced diameter cylindrical portion 97 and a frusto-conical portion 98. The end portion of the tandem needle valve 90 remote from the cylindrical land 95 is a tapered needle portion 99.

The end of the bore 91 remote from the cylindrical land 95 is open and comprises an outlet port which is connected to the induction passage 13 by the supplementary air supply passage 100. Another outlet port 101 in the bore 91, which is connected to the air supply passage 22 is separated from the open end of the bore 91 by that part of the bore 91 in which the two inlet ports 93 and 94 are formed.

Communication between the inlet port 93 and the outlet port 101 is controlled by the cylindrical land 95 and the frusto-conical portion 98. The needle portion 99 restricts flow between the inlet port 94 and the supplementary air supply passage 100 and serves as the variable flow restricting device in that passage.

The influence of any variation in the air flow through the air supply passage 22 that is afforded by the tandem needle valve 90 upon the air/fuel ratio of the charge drawn into the engine 14 from the carburetor 10 at idling is insignificant compared with the influence upon that air/fuel ratio of a change in the air flow through the supplementary air supply passage 100 because there is a much greater delay between the former and the analogue control signal emitted by the lambda sensor 35 to bring that change about them between the latter and the same analogue control signal. On the other hand, the influence of any variation in the air flow through the supplementary air supply passage 100 that is afforded by operation of the tandem needle valve 90 under part throttle or open throttle conditions upon the air/fuel ratio of the charge that is drawn into the engine 14 from the carburetor 10 is insignificant compared with the influence upon that air/fuel ratio of a change in air flow through the air supply passage 22 because the mass flow through the induction passage under part throttle or open throttle conditions is much greater than under engine idling conditions, and because the delay between any such change in air flow through the air supply passage 22 and the analogue control signal that initiated such a change is much less under part throttle or open throttle conditions than under engine idling conditions.

The invention can be applied to a fixed choke carburetor if a supplementary air supply passage, such as has been described above with reference to FIG. 9, is provided for feeding supplementary air to the induction passage downstream of the throttle valve, in addition to the provision of an air supply passage for feeding air to a fuel supply jet which includes a fuel metering orifice of the carburetor, flow through the two air supply passages being controlled in response to an analogue control signal emitted by a lambda sensor or like device.

I claim:

1. A spark ignition internal combustion engine installation which comprises a carburetor of the air valve type and an exhaust system; the carburetor having a body in which an induction passage is formed, the induction passage providing a flow path for air which is drawn into the engine by operation of the engine, a driver operable throttle valve for controlling the mass flow of air through the induction passage, an air valve upstream of the driver operable throttle valve, the air valve cooperating with a wall portion of the induction passage to form a throat of restricted dimensions and being controlled by the depression that is established in that part of the induction passage between the throttle valve and the air valve in order to vary the area of the throat and maintain that depression substantially constant, and only one fuel supply system for supplying metered quantities of fuel to that part of the induction passage between the throttle valve and the air valve, said fuel supply system comprising a fuel metering section, a fuel discharge nozzle and a source of liquid fuel and being arranged so that metered quantities of liquid fuel are drawn from said source through the fuel metering section and the fuel discharge nozzle into the induction passage by air flow through said throat whereby fuel drawn through the discharge nozzle is atomized and dispersed within that part of the induction passage between the throat and the throttle valve so as to mix with air that flows through said throat and to form an air/fuel mixture which flows to the engine; the engine installation also including sensing means which are operable to monitor the ratio between the quantity of one of the constituents of gas flow at a location downstream of the throttle valve and the remainder of that gas flow and to emit a signal when that ratio differs from a predetermined optimum ratio by a predetermined amount, that signal being indicative of the sense of the difference between the ratio that is sensed at any one instant and the predetermined optimum ratio, an air flow passage which is connected to the fuel supply system between the fuel metering section and the fuel discharge nozzle, variable air flow metering means for metering air flow through the air flow passage so that metered quantities of air are drawn into the fuel supply system upstream of the fuel discharge nozzle and are mixed therein with fuel that is drawn through the fuel metering section so that a mixture of metered quantities of fuel and air is drawn through the fuel discharge nozzle into the induction passage by air flow through the throat, the quantity of air drawn from the air flow passage into the fuel supply system upstream of the fuel discharge nozzle being metered by the variable air flow metering means, varying means which are operable to vary the performance of the air flow metering means, and signal transmitting means connected to the varying means and the sensing means so as to transmit to the varying means the signal that is emitted by the sensing means, the varying means being operable in response to a signal received from the sensing means to vary the performance of the air flow metering means so that the pressure drop across the fuel metering section is varied by the consequent change in the air flow through said air flow passage with the result that the quantity of fuel drawn from the source through the fuel metering section and the fuel discharge nozzle into the induction passage by a given air flow through the throat is changed, the variation in the pressure drop across the fuel metering section being the form of variation that will lead to a reduction in the difference between the said ratio and the predetermined optimum ratio.

2. A spark ignition internal combustion engine as claimed in claim 1 wherein the variable air flow metering means comprise a needle valve.

3. A spark ignition internal combustion engine as claimed in claim 1 wherein the variable air flow metering means comprise a rotary valve which comprises a housing; a cavity which is formed in the housing; an air inlet port and an air outlet port which are formed in the housing, which communicate with the cavity within the housing and which are connected into the air flow passage, the air outlet port being connected to the fuel supply system by the downstream portion of the air flow passage; and a rotary element which is coupled to said varying means for rotation within the cavity and which cooperates with the outlet port so that, for at least some of the angular positions of the rotary element within the cavity, part of the outlet port is obscured from the interior of the cavity by the rotary element, the proportion of the outlet port that is obscured from the interior of the cavity by the rotary element being varied by rotation of the rotary element within the cavity.

4. A spark ignition internal combustion engine as claimed in claim 3 wherein the rotary element comprises a disc which has an arcuate slot formed in it, the width of the arcuate slot, as measured radially with respect to the axis of rotation of the disc, being smaller at one end of the arcuate slot than at the other end of the arcuate slot and increasing progressively from said one end along the slot towards said other end.

5. A spark ignition internal combustion engine as claimed in claim 1, wherein the sensing means comprise exhaust gas constituent sensing means which are included in the exhaust system and which are operable to monitor the ratio between the quantity of one of the constituents of the gas flow that is exhausted from the engine by operation of the engine and the remainder of that exhaust gas flow.

6. A spark ignition internal combustion engine as claimed in claim 5, wherein the tandem needle valve includes a cylindrical land by which said one outlet port can be blocked.

7. A spark ignition internal combustion engine installation which includes a carburetor and an exhaust system; the carburetor having a body in which an induction passage is formed, the induction passage providing a flow path for air which is drawn into the engine by operation of the engine, a driver operable throttle valve for controlling the mass flow of air through the induction passage, and a fuel supply system comprising a fuel metering section, a fuel discharge nozzle and a source of liquid fuel, the fuel supply system being arranged so that metered quantities of liquid fuel are drawn from said source through the fuel metering section and the fuel discharge nozzle into the induction passage by air flow through said throat whereby fuel drawn through the discharge nozzle is atomized and dispersed within that part of the induction passage between the throat and the throttle valve so as to mix with air that flows through said throat and to form an air/fuel mixture which flows to the engine; the engine installation also including sensing means which are operable to monitor the ratio between the quantity of one of the constituents of gas flow at a location downstream of the throttle valve and the remainder of that gas flow and to emit a signal when that ratio differs from a predetermined optimum ratio by a predetermined amount, the signal being indicative of the sense of the difference between the ratio that is sensed at any one instant and the predetermined optimum ratio; an air flow passage which is connected to the fuel supply system between the fuel metering section and the fuel discharge nozzle, variable air flow metering means for metering air flow through the air flow passage so that metered quantities of air are drawn into the fuel supply system upstream of the fuel discharge nozzle and are mixed therein with fuel that is drawn through the fuel metering section whereby a mixture of metered quantities of fuel and air is drawn through the fuel discharge nozzle into the induction passage by air flow through the throat, the quantities of air drawn from the air flow passage into the fuel supply system upstream of the fuel discharge nozzle being metered by the variable air flow metering means, varying means which are operable to vary the performance of the air flow metering means, and signal transmitting means connected to the varying means and the sensing means so as to transmit to the varying means the signal that is emitted by the sensing means, the varying means being operable in response to a signal received from the sensing means to vary the performance of the air flow metering means so that the pressure drop across the fuel metering section is varied by the consequent change in the air flow through said air flow passage with the result that the quantity of fuel drawn from the source through the fuel metering section and the fuel discharge nozzle into the induction passage by a given air flow through the throat is changed, the variation in the pressure drop across the fuel metering section being the form of variation that will lead to a reduction in the difference between the said ratio and the predetermined optimum ratio; a supplementary air supply passage which is connected to the induction passage downstream of the throttle valve, a variable flow restricting device in said supplementary air supply passage, control means for controlling the variable flow restricting device, and further signal transmitting means connected to the control means for transmitting to said control means the signal that is emitted by the sensing means, the control means being operable in response to a signal received via the further signal transmitting means from the sensing means to vary the restriction to air flow through said supplementary air supply passage afforded by said variable flow restricting device, the variation in the restriction to air flow through said supplementary air supply passage being the form of variation that will lead to a reduction in the difference between the said ratio and the predetermined optimum ratio when the engine is idling.

8. A spark ignition internal combustion engine as claimed in claim 7, wherein the sensing means comprise exhaust gas constituent sensing means which are included in the exhaust system and which are operable to monitor the ratio between the quantity of one of the constituents of the gas flow that is exhausted from the engine by operation of the engine and the remainder of that exhaust gas flow.

9. A spark ignition internal combustion engine as claimed in claim 8, wherein the tandem needle valve includes another cylindrical land between the two needle portions.

10. A spark ignition internal combustion engine as claimed in claim 7 wherein said variable air flow metering means and said variable flow restricting device are coupled together for complementary operation under the control of a common control device which functions as both said varying means and said variable flow restricting device control means.

11. A spark ignition internal combustion engine as claimed in claim 10 wherein the combined variable air flow metering means and said variable flow restricting device comprise a tandem needle valve.

12. A spark ignition internal combustion engine as claimed in claim 11, wherein the tandem needle valve is a sliding fit within a bore and controls communication between each of a pair of inlet ports within the bore and each of a pair of outlet ports within the bore, one of the outlet ports being connected to the fuel supply system by said air flow passage and the other outlet port being connected to the induction passage downstream of the throttle valve by said supplementary air supply passage.

* * * * *